US008033637B2

(12) United States Patent
Kubo

(10) Patent No.: US 8,033,637 B2
(45) Date of Patent: Oct. 11, 2011

(54) IMAGE FORMING APPARATUS WITH MAINTENANCE-AND-RECOVERY MECHANISM

(75) Inventor: Isamu Kubo, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 890 days.

(21) Appl. No.: 12/035,161

(22) Filed: Feb. 21, 2008

(65) Prior Publication Data

US 2008/0204505 A1 Aug. 28, 2008

(30) Foreign Application Priority Data

Feb. 27, 2007 (JP) ..... 2007-046354

(51) Int. Cl.
*B41J 2/165* (2006.01)

(52) U.S. Cl. ..... 347/30

(58) Field of Classification Search ..... 347/22–36
See application file for complete search history.

(56) References Cited

U.S. PATENT DOCUMENTS

| | | | | |
|---|---|---|---|---|
| 4,340,897 | A * | 7/1982 | Miller | 347/33 |
| 4,556,894 | A * | 12/1985 | Terasawa | 347/30 |
| 6,024,433 | A * | 2/2000 | Tsurui et al. | 347/26 |
| 6,123,408 | A * | 9/2000 | Ishize et al. | 347/30 |
| 6,257,697 | B1 * | 7/2001 | Kurata | 347/33 |
| 6,461,064 | B1 * | 10/2002 | Leonard et al. | 400/328 |
| 6,540,322 | B2 * | 4/2003 | Usui et al. | 347/29 |
| 6,543,876 | B2 * | 4/2003 | Kotaki | 347/30 |
| 6,733,108 | B2 * | 5/2004 | Barton et al. | 347/36 |
| 7,213,903 | B2 * | 5/2007 | Danzuka | 347/30 |
| 7,240,984 | B2 * | 7/2007 | Kayanaka | 347/23 |
| 7,748,817 | B2 * | 7/2010 | Akase | 347/23 |
| 7,866,789 | B2 * | 1/2011 | Shigeno et al. | 347/30 |
| 2004/0218001 | A1 * | 11/2004 | Takahashi et al. | 347/30 |
| 2006/0214981 | A1 * | 9/2006 | Fukasawa et al. | 347/29 |

FOREIGN PATENT DOCUMENTS

| | | |
|---|---|---|
| JP | 61-92206 | 5/1986 |
| JP | 10-793 | 1/1998 |
| JP | 2001-130029 | 5/2001 |
| JP | 2002-225313 | 8/2002 |
| JP | 3406348 | 3/2003 |
| JP | 2004-216820 | 8/2004 |
| JP | 2005-144940 | 6/2005 |
| JP | 2006-218729 | 8/2006 |

* cited by examiner

*Primary Examiner* — Charlie Peng
(74) *Attorney, Agent, or Firm* — Cooper & Dunham LLP

(57) ABSTRACT

An image forming apparatus has a liquid discharge head to discharge droplets of a recording liquid to form an image on a recording medium and a maintenance-and-recovery mechanism to perform a maintenance and recovery operation on the liquid discharge head. The maintenance-and-recovery mechanism includes a suction device, a control unit, a drain tube, and a drain reservoir. The suction device suctions droplets of the recording liquid from the liquid discharge head. The suctioned droplets are not used for an image forming operation. The control unit controls a suction speed of the suction device. The drain reservoir stores the suctioned droplets drained from the drain tube. The drain tube is inclined relative to an opening portion of the drain reservoir. The control unit controls the suction speed of the suction device to change a drain speed of the suctioned droplets drained from the drain tube.

16 Claims, 7 Drawing Sheets

IMAGE FORMING APPARATUS WITH MAINTENANCE-AND-RECOVERY MECHANISM

CROSS-REFERENCE TO RELATED APPLICATIONS

The present patent application claims priority under 35 U.S.C. §119 from Japanese Patent Application No. 2007-046354 filed on Feb. 27, 2007 in the Japan Patent Office, the entire contents of which are hereby incorporated herein by reference.

BACKGROUND OF THE INVENTION

1. Technical Field of the Invention

This disclosure generally relates to image forming apparatuses, and more specifically, to an image forming apparatus capable of preventing waste liquid from accumulating at a certain place in a drain reservoir.

2. Description of the Background

An image forming apparatus used as a printer, facsimile machine, copier, multi-functional device thereof, or plotter may have a recording head configured as, for example, a liquid discharge head for discharging liquid droplets of a recording liquid such as ink. Such image forming apparatuses discharge liquid droplets of a recording liquid from nozzles of the liquid discharge head to form a desired image on a recording medium, for example, a paper sheet.

However, in such image forming apparatuses, standby operation, high-temperature and/or low-humidity environment, and low printing frequency may increase the viscosity of the recording liquid, thereby resulting in clogging of the nozzles. Accordingly, such image forming apparatuses generally have a function to maintain and recover the discharge performance of the recording head.

As one example of such a maintenance and recovery function, a conventional image forming apparatus performs an idle discharge operation to discharge liquid droplets not contributing to image recording from nozzles at certain intervals or as needed, thus removing such viscosity-increase liquid from the recording head.

Such a conventional image forming apparatus may also have an idle discharge receiver to receive liquid droplets discharged from the nozzles during such an idle discharge operation. In such an idle discharge receiver, color materials, for example, pigment or dye, contained in a recording liquid may accumulate and grow over time. If such growth of accumulated color materials is not removed, the accumulated color materials may come into contact with a nozzle formation face of the recording head, thereby resulting in an operation failure of the recording head.

Hence, several measures have been proposed to deal with such accumulated materials.

In one example, a conventional inkjet image forming apparatus has a cleaning unit to prevent overflow or contamination of waste liquid. The cleaning unit includes a suction device to suction ink from discharge orifices, an ink passage tube through which to pass the suctioned ink, a drain reservoir to store the ink drained through the ink passage tube, and a shifting unit to shift a position of an end opening of the ink passage tube. When performing a cleaning operation using the cleaning unit, the conventional inkjet image forming apparatus shifts the position of the end opening of the ink passage tube so that such waste ink is relatively uniformly distributed over substantially an entire floor area of the drain reservoir.

In one example, a waste-liquid removal structure is proposed for a conventional inkjet image forming apparatus. The conventional image forming apparatus has a tube to guide waste liquid into a waste liquid tank, and an end opening of the tube is disposed at a certain height relative to the waste liquid tank. In order to remove the waste liquid accumulated below the end opening of the tube, the waste-liquid removal structure has a belt conveyor horizontally disposed in the waste liquid tank and a scraper uprightly disposed on a bottom portion of the waste liquid tank.

However, the above-described conventional inkjet image forming apparatuses have certain disadvantages, for example, relatively large size or highly complex configuration.

In one example, a conventional inkjet recording apparatus has a configuration in which an end opening for pigment waste liquid and an end opening for dye waste liquid are positioned adjacent each other. Such a configuration allows the two types of waste liquids to mix, thereby dissolving a solid deposit of the pigment waste liquid or suppressing solidification and accumulation of such pigment waste liquid. However, in such a conventional inkjet recording apparatus, pigment component may not be fully dissolved and therefore may result in the fixation and accumulation of such pigment waste liquid.

In one example, a conventional liquid discharge apparatus has a controller to change the rotation speed of a tube pump. In the conventional liquid discharge apparatus, the controller controls the tube pump to rotate at a relatively high speed for a given time period and then rotate at a relatively low speed for a given time period. However, such a configuration may need a relatively complex control operation to change the rotation speed of the tube pump. Moreover, repeating such a relatively complex speed change may adversely affect the durability of the tube pump.

In one example, for a conventional image forming apparatus, an idle discharge receiver is proposed that removes deposits of waste liquid accumulated at a slope portion that is provided to receive a recording liquid. The idle discharge receiver has a swing member including a plurality of swing plates coupled with coupling ribs. The swing plates are reciprocated parallel to a surface of the slope portion while keeping away from the slope portion. However, such a configuration has a disadvantage that, as the amount of ink attached to the swing member increases over time, such ink may intrude into gaps among components, so that the movement of the swing member may be prevented.

Thus, there is still a need for an image forming apparatus having a simple configuration and capable of relatively uniformly draining of waste liquid into a drain reservoir while maintaining stable operation without an increase in overall size.

BRIEF SUMMARY OF THE INVENTION

In an aspect of this disclosure, there is provided an image forming apparatus capable of preventing waste liquid from accumulating at a certain place in a drain reservoir.

In another aspect, an image forming apparatus has a liquid discharge head and a maintenance-and-recovery mechanism. The liquid discharge head discharges droplets of a recording liquid to form an image on a recording medium. The maintenance-and-recovery mechanism performs a maintenance and recovery operation on the liquid discharge head. The maintenance-and-recovery mechanism includes a suction device, a control unit, a drain tube, and a drain reservoir. The suction device suctions droplets of the recording liquid from the liquid discharge head. The suctioned droplets are not used for an image forming operation. The control unit controls a suction speed of the suction device. The drain tube drains the suctioned droplets suctioned by the suction device. The drain reservoir stores the suctioned droplets drained from the drain tube. The drain tube is inclined relative to an opening portion of the drain reservoir. The control unit controls the suction speed of the suction device to change a drain speed with which the suctioned droplets are drained from the drain tube.

BRIEF DESCRIPTION OF THE DRAWINGS

A more complete appreciation of the disclosure and many of the attendant aforementioned and other features, aspects and advantages will be better understood by reference to the following detailed description when considered in connection with the accompanying drawings, wherein.

Figure 1:
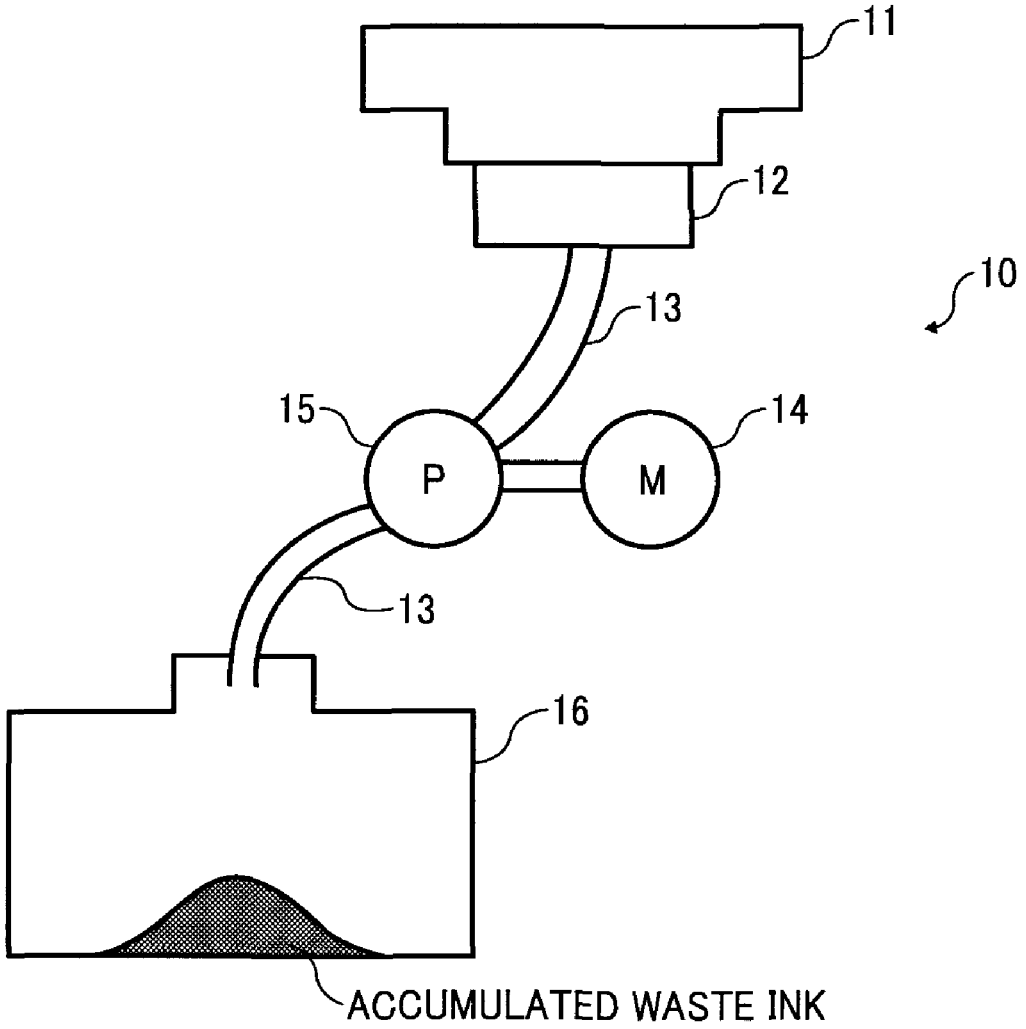
FIG. 1 is a schematic view illustrating a general configuration of maintenance-and-recovery mechanisms used in image forming apparatuses according to exemplary embodiments of the present invention.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve the same results. For the sake of simplicity, the same reference numerals are used in the drawings and the descriptions for the same materials and constituent parts having the same functions, and redundant descriptions thereof are omitted.

Exemplary embodiments of the present disclosure are now described below with reference to the accompanying drawings. It should be noted that, in a later-described comparative example, exemplary embodiment, and alternative example, the same reference numerals are used for the same constituent elements such as parts and materials having the same functions, and redundant descriptions thereof are omitted.

FIG. 1 is a schematic view illustrating a general configuration of maintenance-and-recovery mechanisms used in image forming apparatuses according to exemplary embodiments of the present invention.

For a maintenance-and-recovery mechanism 10 illustrated in FIG. 1, when viscosity-increased ink or bubbles appear in a recording head 11, the recording head 11 may become unable to discharge ink normally. Hence, a nozzle formation face of the recording head 11 is sealed with a cap 12, and such viscosity-increased ink or bubbles are suctioned from a drain tube 13, communicating with the cap 12, by using a suction device, for example, a pump 15 driven by a motor 14 serving as a drive source. The viscosity-increased ink or bubbles suctioned by the pump 15 are drained to a drain reservoir 16, thus maintaining the recording head 11 in a normal state.

However, when a highly viscous ink, for example, a pigmented ink, is used, such a highly viscous ink may accumulate in a solid state in the drain reservoir 16. Particularly in a low-humidity environment, such solid accumulation may occur due to air drying.

Hence, image forming apparatuses according to exemplary embodiments of the present invention are configured as follows.

Figure 2A:
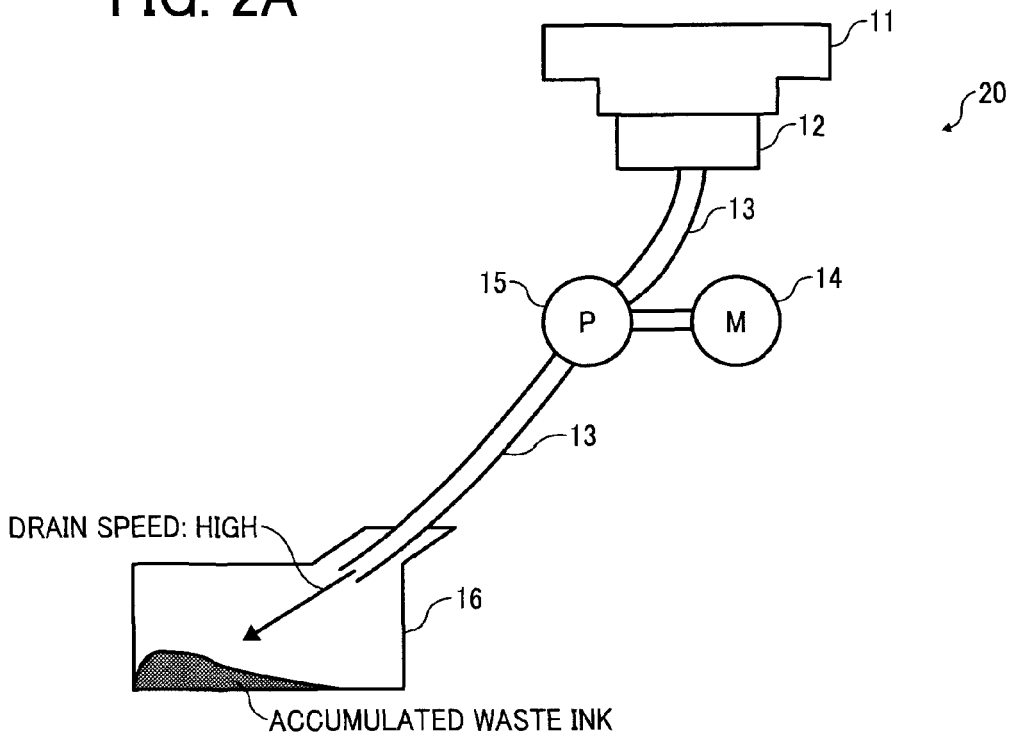
FIGS. 2A to 2C are schematic views illustrating a configuration of a maintenance-and-recovery mechanism of an image forming apparatus according to a first exemplary embodiment.
Figure 2B:
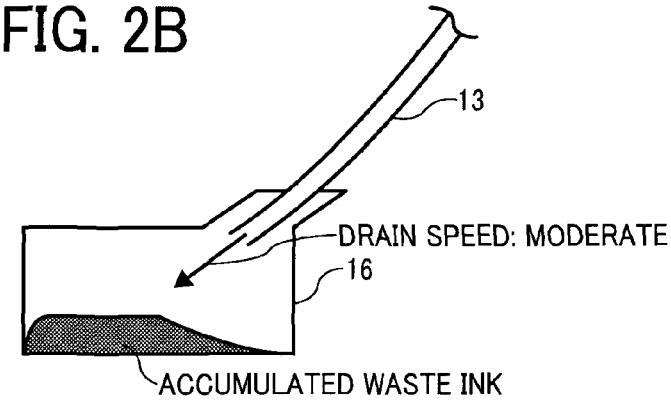
Figure 2C:
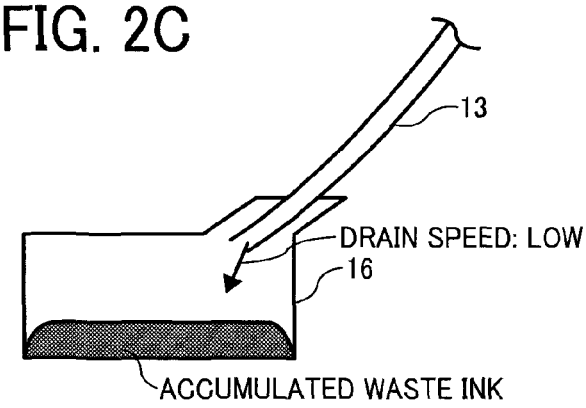

FIGS. 2A to 2C are schematic views illustrating a configuration of a maintenance-and-recovery mechanism of an image forming apparatus according to a first exemplary embodiment. In FIGS. 2A to 2C, reference characters identical to those of FIG. 1 refer to identical components.

In a maintenance-and-recovery mechanism 20 illustrated in FIGS. 2A to 2C, a drain tube 13 is inclined relative to an opening face of a drain reservoir 16, and the suction speed of a pump 15 is controlled to change the speed at which waste ink is drained from an end opening of the drain tube 13.

For example, as illustrated in FIG. 2A, when the suction speed of the pump 15 is increased, the drain speed of the waste ink from the end opening of the drain tube 13 is increased, and thereby such waste ink is drained to a distal end side of the drain reservoir 16 that is distal relative to the drain tube 13.

Further, as illustrated in FIG. 2B, when the suction speed of the pump 15 is moderate, the drain speed of waste ink from the end opening of the drain tube 13 is moderated, and thereby such waste ink is drained to an intermediate portion of the drain reservoir 16.

Furthermore, as illustrated in FIG. 2C, when the suction speed of the pump 15 is decreased, the drain speed of waste ink from the end opening of the drain tube 13 is decreased and thereby such waste ink is drained to a proximal end side of the drain reservoir 16 relative the drain tube 13. Thus, the maintenance-and-recovery mechanism 20 is capable of draining waste ink over substantially an entire floor area of the drain reservoir 16.

Figure 3:
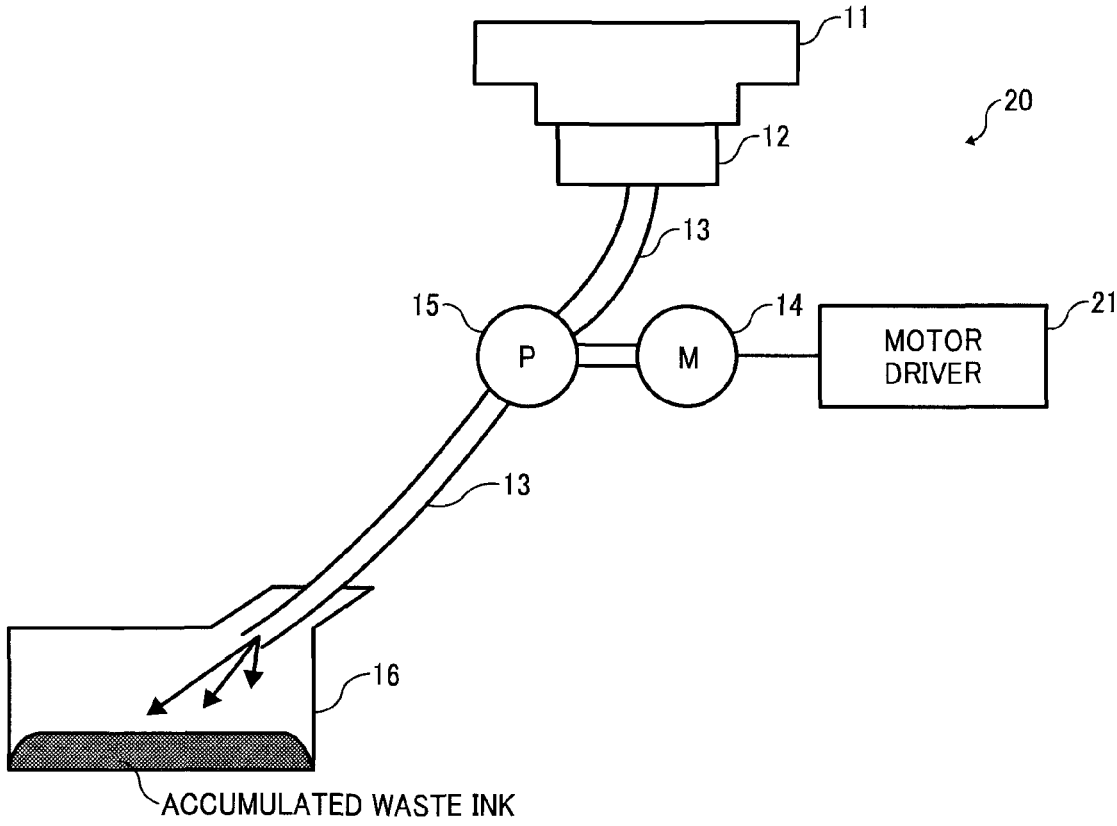
FIG. 3 is a schematic view illustrating a configuration of a maintenance-and-recovery mechanism used in an image forming apparatus according to a second exemplary embodiment.

FIG. 3 is a schematic view illustrating a configuration of a maintenance-and-recovery mechanism used in an image forming apparatus according to a second exemplary embodiment. In FIG. 3, reference characters identical to those of FIG. 2 refer to identical components.

In a maintenance-and-recovery mechanism 20 illustrated in FIG. 3, a drain tube 13 is inclined relative to an opening face of a drain reservoir 16. The maintenance-and-recovery mechanism 20 has a motor driver 21, serving as a control unit, to control a motor 14 to change the suction speed of a pump 15.

For example, when the motor 14 is a DC (direct current) motor, the motor driver 21 changes the speed of the motor 14 by current control. Alternatively, when the motor 14 is a stepping motor, the motor driver 21 changes the speed of the motor 14 by pulse control.

Figure 4A:
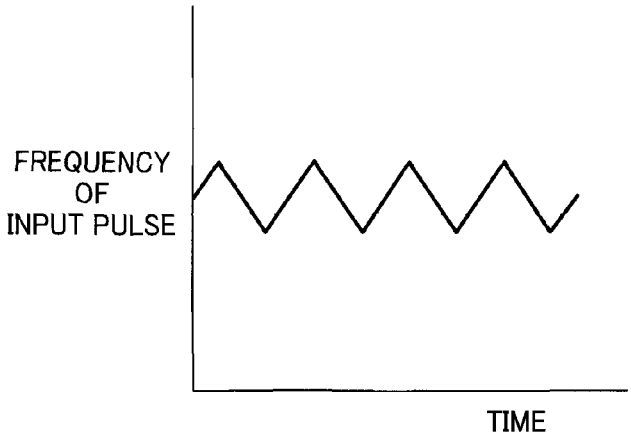
FIGS. 4A to 4C are wave form diagrams illustrating input pulses generated when a stepping motor is used in the maintenance-and-recovery mechanism of FIG. 3.
Figure 4B:
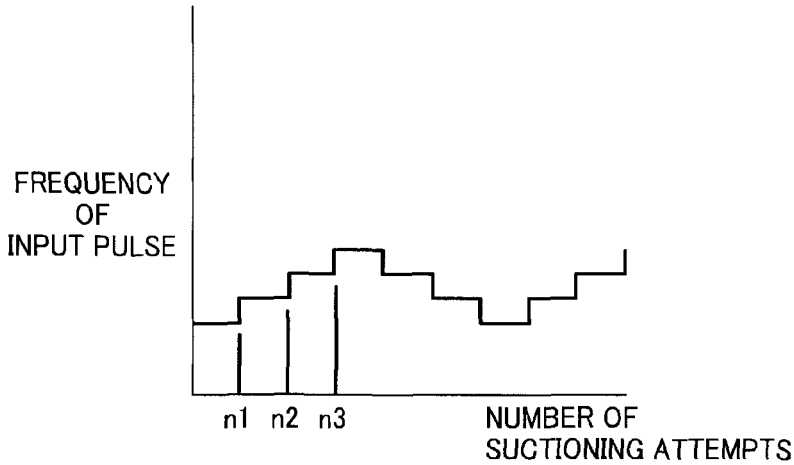
Figure 4C:
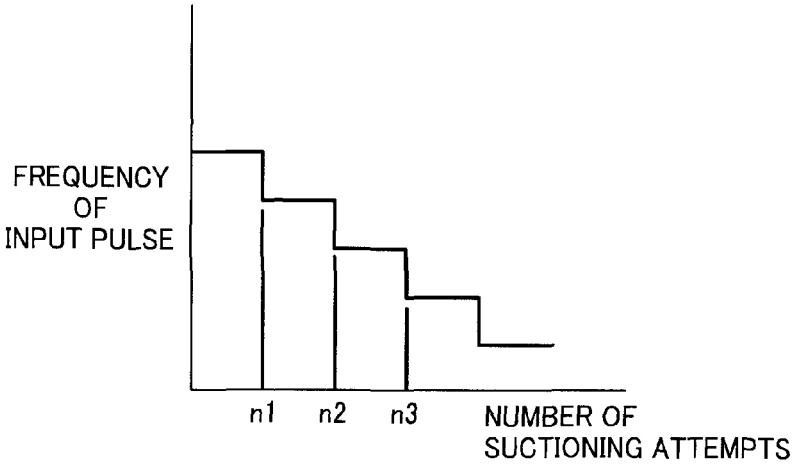

More specifically, as illustrated in FIG. 4A, in a case in which a stepping motor is used as a drive source of the pump 15, a triangular wave is used as the frequency of input pulse to continuously change the drain speed of waste ink. In such a case, as illustrated in FIG. 4B, every time the number of suctioning attempts reaches a first number, the frequency of input pulse may be changed to change the drain speed of waste ink. Alternatively, as illustrated in FIG. 4C, every time the number of suctioning attempts reaches a second number, the frequency of input pulse may be reduced to decrease the drain speed of waste ink.

Figure 5:
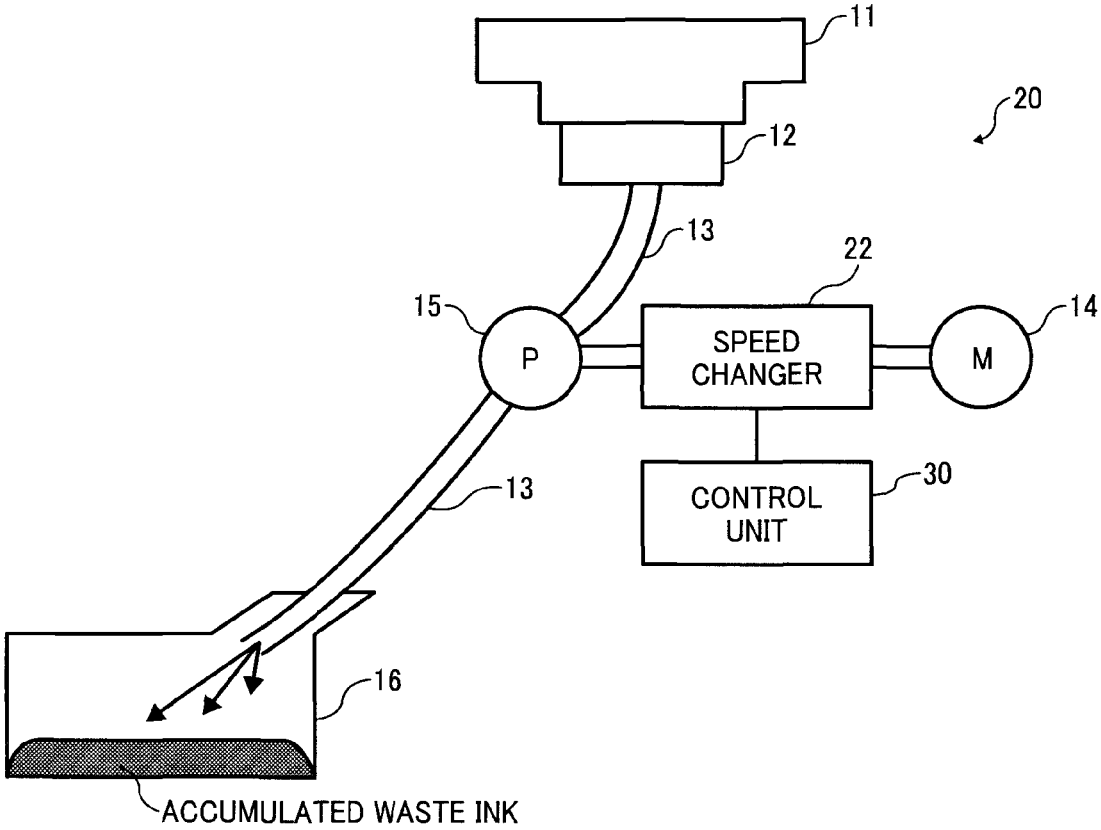
FIG. 5 is a schematic view illustrating a configuration of a maintenance-and-recovery mechanism of an image forming apparatus according to a third exemplary embodiment.

FIG. 5 is a schematic view illustrating a configuration of a maintenance-and-recovery mechanism of an image forming apparatus according to a third exemplary embodiment. In FIG. 5, reference characters identical to those of FIG. 2 refer to identical components.

In FIG. 5, a maintenance-and-recovery mechanism 20 has a cap 12, a drain tube 13, a motor 14, a pump 15, a drain reservoir 16, a speed changer 22, and a control unit 30. The drain tube 13 is inclined relative to an opening face of a drain reservoir 16, and the motor 14 is driven at a substantially constant speed. The speed changer 22 is provided between the motor 14 and the pump 15. The control unit 30 controls the drive speed of the pump 15 via the speed changer 22 to change the speed at which waste ink is drained from an end opening of a drain tube 13.

Figure 6A:
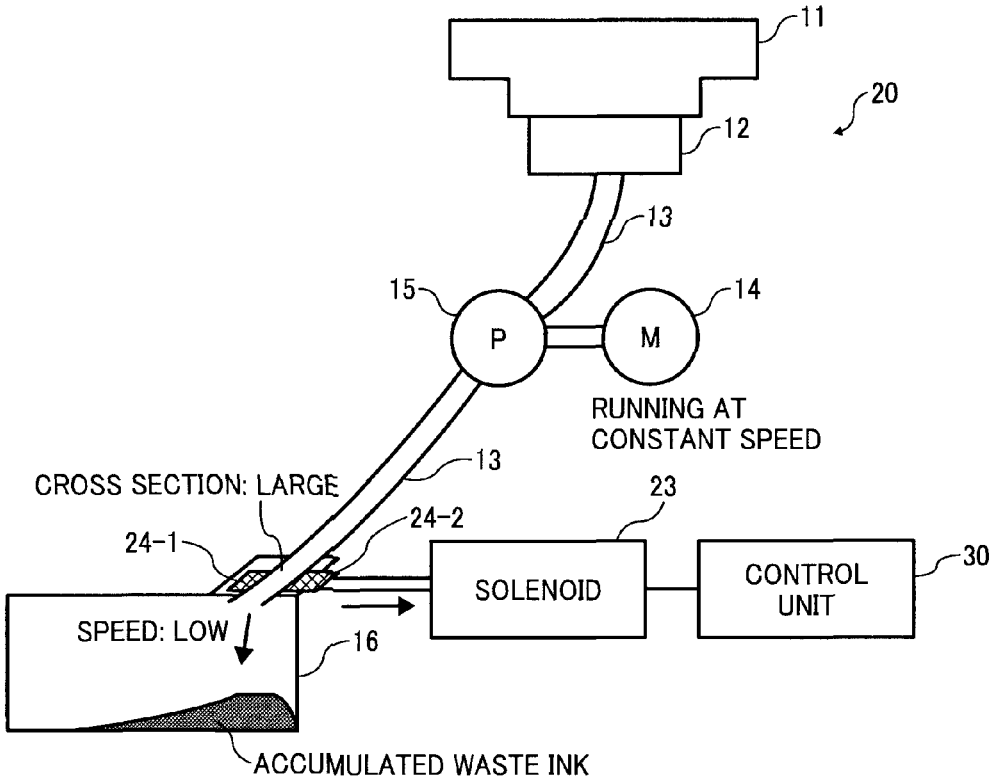
FIGS. 6A and 6B are schematic views illustrating a configuration of a maintenance-and-recovery mechanism of an image forming apparatus according to a fourth exemplary embodiment.
Figure 6B:
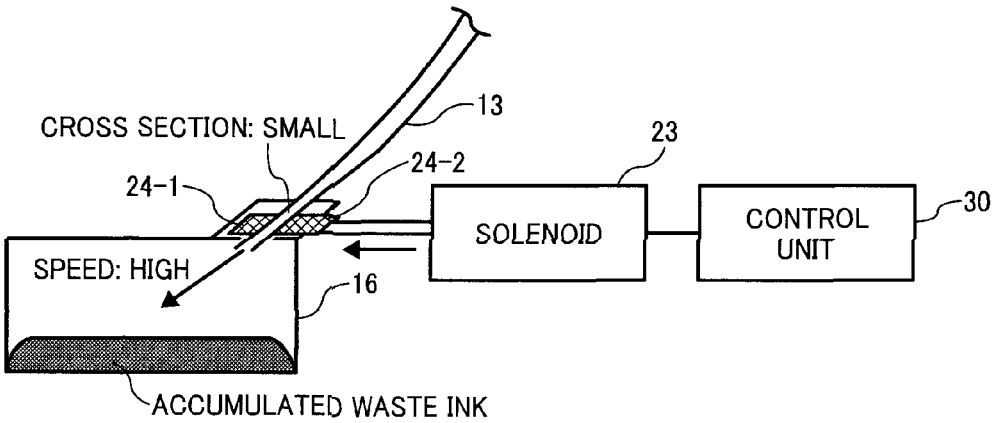

FIGS. 6A and 6B are schematic views illustrating a configuration of a maintenance-and-recovery mechanism of an image forming apparatus according to a fourth exemplary embodiment. In FIGS. 6A and 6B, reference characters identical to those of FIG. 2 refer to identical components.

In a maintenance-and-recovery mechanism 20, a fixed member 24-1 and a moving member 24-2 sandwiches an end opening of a drain tube 13, with the moving member 24-2 moved by a solenoid 23. A control unit 30 controls the solenoid 23 to move the moving member 24-2. Thus, the fixed member 24-1 and the moving member 24-2 serve as an adjustment unit to adjust a cross-sectional area of the end opening of the drain tube 13, so as to change the speed with which waste ink is drained from the end opening of the drain tube 13.

For example, as illustrated in FIG. 6A, when the solenoid 23 moves the moving member 24-2 so as to open the end opening of the drain tube 13, the cross sectional area of the end opening of the drain tube 13 is increased, thereby reducing the drain speed of waste ink from the end opening of the drain tube 13. By contrast, as illustrated in FIG. 6B, when the solenoid 23 moves the moving member 24-2 so as to press the end opening of the drain tube 13, the cross-sectional area of the end opening of the drain tube 13 is decreased, thereby increasing the drain speed of waste ink from the end opening of the drain tube 13. Thus, the maintenance-and-recovery mechanism 20 is capable of relatively uniformly draining waste ink over substantially an entire floor area of the drain reservoir.

Figure 7A:
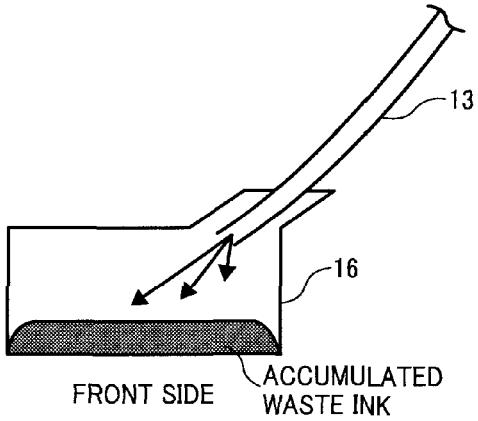
FIGS. 7A and 7B are schematic views illustrating a configuration of a maintenance-and-recovery mechanism of an image forming apparatus according to a fifth exemplary embodiment.
Figure 7B:
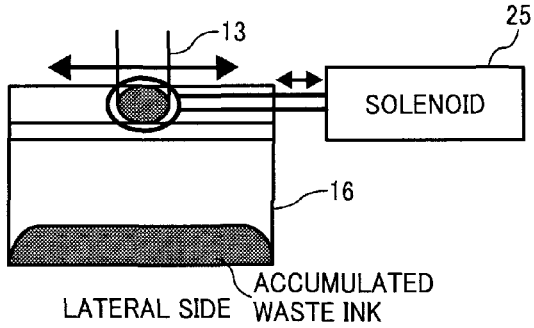

FIGS. 7A and 7B are schematic views illustrating a configuration of a maintenance-and-recovery mechanism of an image forming apparatus according to a fifth exemplary embodiment. In FIGS. 7A and 7B, reference characters identical to those of FIG. 2 refer to identical components.

In a maintenance-and-recovery mechanism 20, as illustrated in FIG. 7B, a drain tube 13 is moved by a solenoid 25 laterally from side to side relative to a lateral face of a drain reservoir 16. Thus, the maintenance-and-recovery mechanism 20 is capable of relatively uniformly draining waste ink over a substantially entire floor area of the drain reservoir.

Figure 8A:
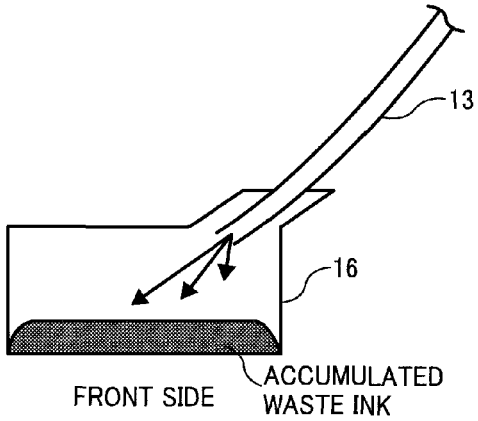
FIGS. 8A and 8B are schematic views illustrating a configuration of a maintenance-and-recovery mechanism of an image forming apparatus according to a sixth exemplary embodiment.
Figure 8B:
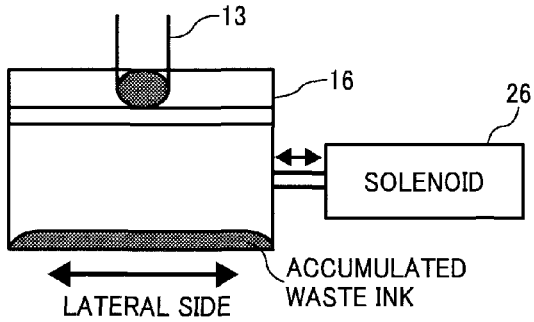

FIGS. 8A and 8B are schematic views illustrating a configuration of a maintenance-and-recovery mechanism of an image forming apparatus according to a sixth exemplary embodiment. In FIGS. 8A and 8B, reference characters identical to those of FIG. 2 refer to identical components.

As illustrated in FIG. 8B, in a maintenance-and-recovery mechanism 20, a drain reservoir 16 is moved by a solenoid 26 laterally from side to side relative to a lateral face of the drain reservoir 16. Thus, the maintenance-and-recovery mechanism 20 is capable of relatively uniformly draining waste ink over a substantially entire floor area of the drain reservoir.

Figure 9A:
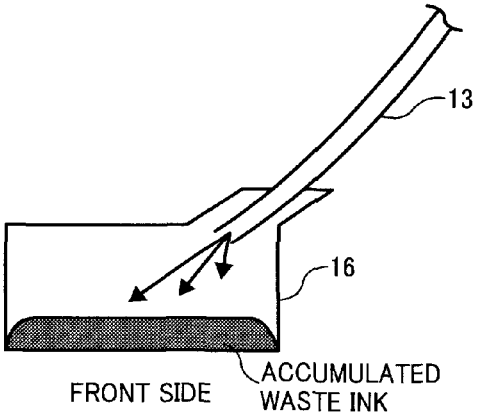
FIGS. 9A and 9B are schematic views illustrating a configuration of a maintenance-and-recovery mechanism of an image forming apparatus according to a seventh exemplary embodiment.
Figure 9B:
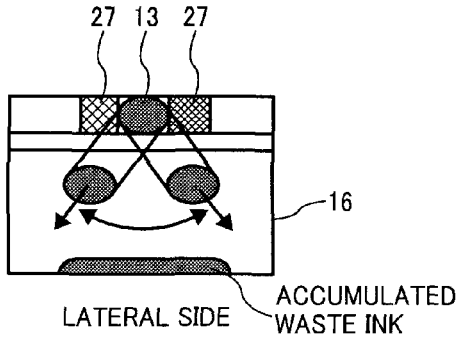

FIGS. 9A and 9B are schematic views illustrating a configuration of a maintenance-and-recovery mechanism of an image forming apparatus according to a seventh exemplary embodiment. In FIGS. 9A and 9B, reference characters identical to those of FIG. 2 refer to identical components.

As illustrated in FIG. 9B, in a maintenance-and-recovery mechanism 20, a drain tube 13 is an elastic member, for example, a silicone tube. Two vibrators 27 are provided, one at either side, at an end opening of the drain tube 13. It should be noted that the number of vibrators 27 is not limited to two and may be any other suitable number. The vibrators 27 vibrate the drain tube 13 laterally from side to side relative to a lateral face of the drain reservoir 13. Thus, the maintenance-and-recovery mechanism 20 is capable of relatively uniformly draining waste ink over a substantially entire floor area of the drain reservoir.

Numerous additional modifications and variations are possible in light of the above teachings. It is therefore to be understood that, within the scope of the appended claims, the disclosure of this application may be practiced otherwise than as specifically described herein.

Further, elements and/or features of different exemplary embodiments and/or examples may be combined with each other and/or substituted for each other within the scope of this disclosure and appended claims.

What is claimed is:

1. An image forming apparatus, comprising:

a liquid discharge head to discharge droplets of a recording liquid to form an image on a recording medium;

a maintenance-and-recovery mechanism to perform a maintenance and recovery operation on the liquid discharge head, the maintenance-and-recovery mechanism comprising:

a suction device to suction droplets of the recording liquid from the liquid discharge head, the suctioned droplets being not used for an image forming operation;

a control unit to control a suction speed of the suction device;

a drain tube to drain the suctioned droplets suctioned by the suction device; and a drain reservoir to store the suctioned droplets drained from the drain tube; and a vibrator unit provided at the end opening of the drain tube to apply vibration to the drain tube, wherein the drain tube is made of an elastic member, wherein the drain tube is inclined relative to an opening portion of the drain reservoir and the control unit controls the suction speed of the suction device to change a drain speed of the suctioned droplets drained from the drain tube.

2. The image forming apparatus according to claim 1, further comprising a drive source to drive the suction device, wherein the control unit controls a drive speed of the drive source.

3. The image forming apparatus according to claim 1, further comprising a speed changer provided between the suction device and the drive source, wherein the control unit controls the speed changer.

4. The image forming apparatus according to claim 1, further comprising an adjustment unit to adjust a cross-sectional area of the drain tube, wherein the control unit controls the adjustment unit.

5. The image forming apparatus according to claim 2, wherein the control unit supplies a signal to the drive source to change the drain speed of the suctioned droplets as the suctioned droplets are suctioned by the suction device.

6. The image forming apparatus according to claim 2, wherein the control unit supplies a signal to the drive source to change the drain speed of the suctioned droplets when the suctioning of the suction device is performed a first number of times.

7. An image forming apparatus, comprising:

a liquid discharge head to discharge droplets of a recording liquid to form an image on a recording medium; and a maintenance-and-recovery mechanism to perform a maintenance and recovery operation on the liquid discharge head, the maintenance-and-recovery mechanism comprising:

a suction device to suction droplets of the recording liquid from the liquid discharge head, the suctioned droplets being not used for an image forming operation;

a control unit to control a suction speed of the suction device;

a drain tube to drain the suctioned droplets suctioned by the suction device; and a drain reservoir to store the suctioned droplets drained from the drain tube a drive source to drive the suction device, wherein the control unit controls a drive speed of the drive source, wherein the drain tube is inclined relative to an opening portion of the drain reservoir and the control unit controls the suction speed of the suction device to change a drain speed of the suctioned droplets drained from the drain tube, and wherein the control unit supplies a signal to the drive source to stepwisely decrease the drain speed of the suctioned droplets when the suctioning of the suction device is performed a second number of times.

8. The image forming apparatus according to claim 1, wherein the drain tube is movable in a horizontal direction, which is one normal line direction of a velocity vector of the suctioned droplets drained from the drain tube.

9. The image forming apparatus according to claim 1, wherein the drain reservoir is movable in a horizontal direction, which is one normal line direction of a velocity vector of the suctioned droplets drained from the drain tube.

10. The image forming apparatus according to claim 7, further comprising a drive source to drive the suction device, wherein the control unit controls a drive speed of the drive source.

11. The image forming apparatus according to claim 10, wherein the control unit supplies a signal to the drive source to change the drain speed of the suctioned droplets as the suctioned droplets are suctioned by the suction device.

12. The image forming apparatus according to claim 10, wherein the control unit supplies a signal to the drive source to change the drain speed of the suctioned droplets when the suctioning of the suction device is performed a first number of times.

13. The image forming apparatus according to claim 7, further comprising a speed changer provided between the suction device and the drive source, wherein the control unit controls the speed changer.

14. The image forming apparatus according to claim 7, further comprising an adjustment unit to adjust a cross-sectional area of the drain tube, wherein the control unit controls the adjustment unit.

15. The image forming apparatus according to claim 7, wherein the drain tube is movable in a horizontal direction, which is one normal line direction of a velocity vector of the suctioned droplets drained from the drain tube.

16. The image forming apparatus according to claim 7, wherein the drain reservoir is movable in a horizontal direction, which is one normal line direction of a velocity vector of the suctioned droplets drained from the drain tube.

* * * * *